US008784158B2

(12) United States Patent
Weber

(10) Patent No.: US 8,784,158 B2
(45) Date of Patent: Jul. 22, 2014

(54) CONTINUOUS GRINDING MACHINE

(75) Inventor: Georg Weber, Kronach (DE)

(73) Assignee: Hans Weber Maschinenfabrik GmbH, Kronach (DE)

( * ) Notice: Subject to any disclaimer, the term of this patent is extended or adjusted under 35 U.S.C. 154(b) by 246 days.

(21) Appl. No.: 13/478,759

(22) Filed: May 23, 2012

(65) Prior Publication Data

US 2012/0302138 A1 Nov. 29, 2012

(30) Foreign Application Priority Data

May 27, 2011 (DE) ..... 10 2011 050 681

(51) Int. Cl.
*B24B 49/00* (2012.01)
*B24B 21/00* (2006.01)

(52) U.S. Cl.
USPC ..... 451/11; 451/5; 451/6; 451/296; 451/303; 451/305

(58) Field of Classification Search
CPC ..... B24B 49/02; B24B 49/04; B24B 21/02; B24B 21/08; B24B 21/10; B24B 21/14; B24B 21/16; B24B 21/008; B24B 21/06
USPC ..... 451/5, 6, 11, 296–311
See application file for complete search history.

(56) References Cited

U.S. PATENT DOCUMENTS

| | | | | | |
|---|---|---|---|---|---|
| 4,416,090 | A * | 11/1983 | Jonasson | 451/300 |
| 4,498,778 | A * | 2/1985 | White | 356/606 |
| 4,601,134 | A * | 7/1986 | Hessemann | 451/300 |
| 4,621,459 | A * | 11/1986 | Stump et al. | 451/300 |
| 4,676,029 | A * | 6/1987 | Palmer | 451/5 |
| 4,839,994 | A * | 6/1989 | Heesemann | 451/6 |
| 5,140,776 | A * | 8/1992 | Isdahl et al. | 451/5 |
| 6,290,570 | B1 * | 9/2001 | Heesemann | 451/5 |
| 6,299,517 | B1 * | 10/2001 | Weber | 451/309 |
| 6,722,960 | B2 * | 4/2004 | Brooks | 451/65 |
| 8,317,570 | B2 * | 11/2012 | Kundig | 451/5 |

FOREIGN PATENT DOCUMENTS

| | | | |
|---|---|---|---|
| EP | 0 155 380 B1 | 11/1987 | |
| IT | EPA 571343 | * 11/1993 | B24B 21/08 |

* cited by examiner

*Primary Examiner* — George Nguyen
(74) *Attorney, Agent, or Firm* — McCormick, Paulding & Huber LLP

(57) ABSTRACT

In a continuous grinding machine for grinding the surface of flat workpieces (20) with at least one grinding station and a transport device (10) for moving the workpieces (20) relative to the grinding station, the grinding station having at least one grinding assembly (22) with a grinding belt (26) and a pressure device (34) for pressing the grinding belt (26) against the workpiece surface, and with a control device (38) for controlling the pressure device (34) depending on the workpiece contour, the transport device (10) is reversible with respect to its feed direction and the control device (38) has means (36) for detecting the workpiece contour depending on the feed direction.

15 Claims, 1 Drawing Sheet

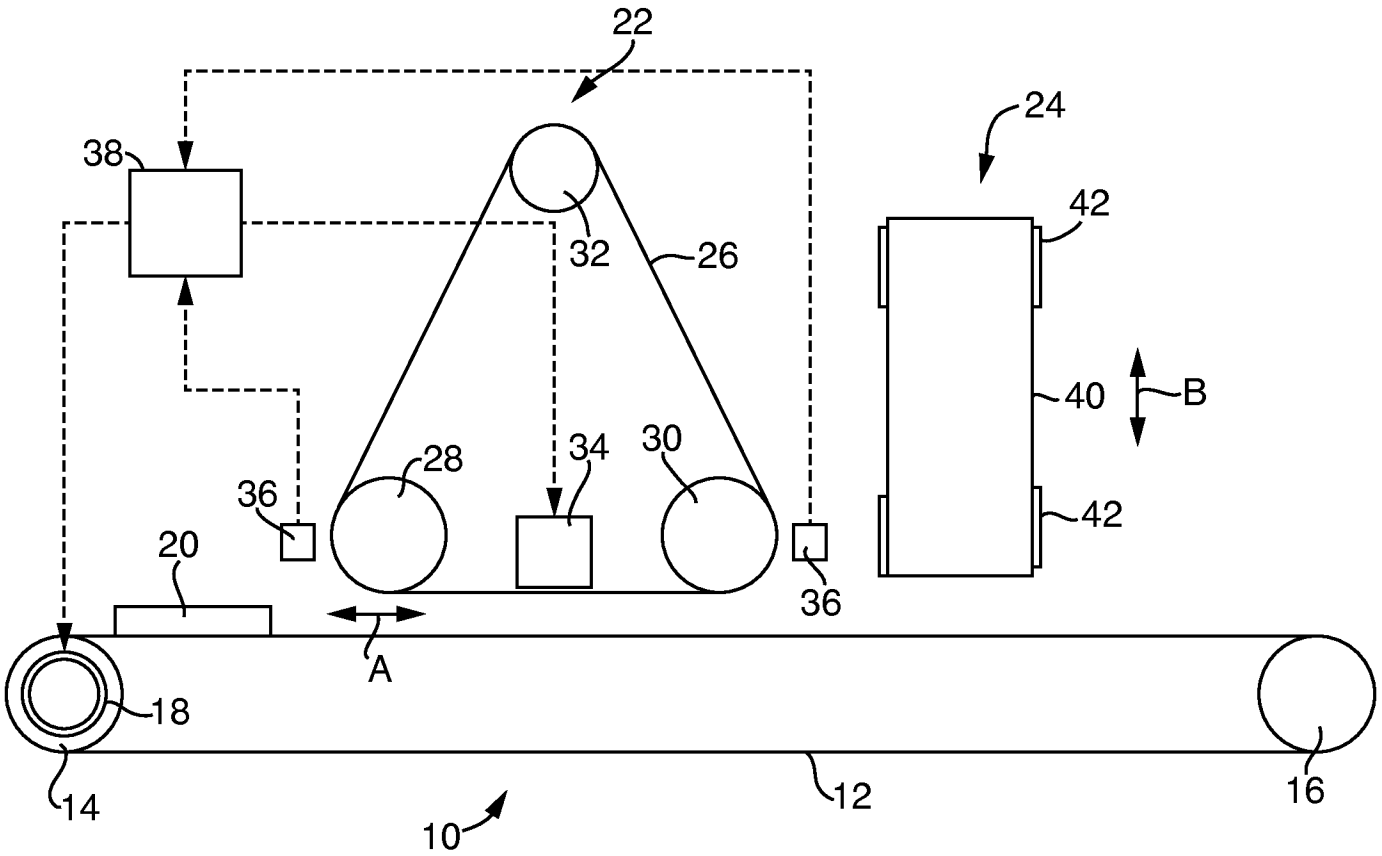
10
12
14
16
18
20
22
24
26
28
30
32
34
36
36
38
40
42
42
A
B

CONTINUOUS GRINDING MACHINE

CROSS REFERENCE TO RELATED APPLICATIONS

Applicant hereby claims foreign priority benefits under 35 U.S.C. § 119 of German Patent Application No. 10 2011 050 681.0 filed May 27, 2011, the disclosures of which are herein incorporated by reference.

TECHNICAL FIELD

The invention concerns a continuous grinding machine for grinding the surface of flat workpieces with at least one grinding station and one transport device for moving the workpieces relative to the grinding station, the grinding station including at least one grinding assembly having a grinding belt and a pressing device for pressing the grinding belt against the work piece surface, and with a control device for controlling the pressing device in accordance with the workpiece contour.

BACKGROUND OF THE INVENTION

A continuous grinding machine of the above-mentioned kind is for example known from EP 155 380 B1. In practise it has become apparent that in many cases the desired grinding result cannot be achieved during one single passage of the workpiece through the grinding station. In case a further machining step is needed, the workpieces either have to be transported back to the machine infeed, which involves additional work expense and time loss, or the machine has to be provided with one or more additional grinding stations which are subsequently passed through by the workpieces, whereby the mechanical efforts, required space, and power consumption are increased during operation.

SUMMARY OF THE INVENTION

It is an object of the invention to provide a continuous grinding machine of the kind mentioned in the introduction which allows achieving the desired grinding result with reduced work expense and/or reduced mechanical effort.

In order to solve this object, according to the invention it is suggested that the transport device is reversible with regard to its feed direction and that the control device comprises means for detecting the workpiece contour depending on the feed direction.

The device according to the invention makes it possible to move the workpieces through the grinding station in a forward and in a backward direction, wherein the surface of the workpieces can be machined during every passage. To achieve this it is not necessary to lift the workpieces from the transport device at the machine outlet or behind the grinding station and to put them back onto the transport device at the machine infeed or to transport the workpieces back to the machine infeed by means of a separate return device. A single grinding station is sufficient for carrying out several subsequent machining steps. In addition to the reversibility of the transport device, also the fact that the pressing device for the grinding belt can be controlled in accordance with the workpiece contour in both feed directions is a decisive factor.

According to a first embodiment, the detection of the workpiece contour can be carried out depending on the feed direction in such a manner that two sensor arrangements are provided, which—when viewed in a first feed direction—are arranged in front of and behind the grinding station, respectively, and which serve to scan the contour of a workpiece as it enters the grinding station. In this case the workpiece is scanned anew for both feed directions.

According to a second embodiment of the invention only one sensor arrangement is provided, which is arranged in front of the grinding station in the manner known from EP 155 380 B1, and the workpiece contour is scanned during the first passage of the workpiece. The data is then stored and inverted during the return passage of the workpiece so that contour signals assigned to the trailing edge of the workpiece during the first passage are assigned to the leading edge of the workpiece during the passage of the workpiece in the opposite direction.

The grinding station can be provided with a longitudinal grinding assembly and/or a transverse grinding assembly. This means that several machining assemblies can be provided for machining the workpiece surface, which, as the case may be, can be used selectively. For example, this may provide for workpieces to be subsequently grinded by a longitudinal belt and a transverse belt during a first passage, while during the passage in the opposite direction only one of the grinding belt assemblies is active. In this manner also complex grinding processes can be carried out with only minor temporal effort and complexity of machinery.

As a matter of course the grinding machine according to the invention can also comprise several grinding stations of the above-mentioned type.

BRIEF DESCRIPTION OF THE DRAWING

The following description explains the invention by means of an embodiment. The single drawing FIGURE shows a schematic side view of a continuous grinding machine according to the invention, having two grinding assemblies.

DETAILED DESCRIPTION OF THE PREFERRED EMBODIMENTS

In the FIGURE, the numeral 10 denotes a workpiece transport device or conveyor having an endless transport belt 12, which runs over rollers 14 and 16, out of which the roller 14 can be driven by a motor 18. The motor 18 is reversible with regard to its drive direction so that the transport belt 12 and thus a workpiece 20 lying on said belt can be moved back and forth in the direction indicated by the double arrow A.

Above the workpiece transport device 10 a longitudinal belt grinding assembly 22 and a transverse belt grinding assembly 24 are arranged in sequence in the transport direction. The longitudinal or wide belt grinding assembly 22 comprises a grinding belt 26 which extends over the entire width of the transport belt 12 and which is guided via two lower rollers 28, 30 and an upper roller 32, one of which rollers 28, 30, 32 being driven. Between the lower rollers 28 and 30 a segmented pressure beam or platen 34 is arranged, whose pressure shoes or pressure segments can be controlled individually such that the grinding belt 26 is pressed against the workpiece surface in accordance with the contour of the workpiece 20.

Sensor arrangements 36 are provided on both sides of the longitudinal belt grinding assembly 22, which sensor arrangements extend via the entire width of the transport belt 12 and with the help of which sensor arrangements the contour of the workpiece 20 can be detected as the workpiece enters below the longitudinal belt grinding assembly 22 both when passing from left to right and when passing from right to left in the drawing FIGURE. The sensor arrangements 36 are connected with a control device 38 which receives the contour data from the sensor arrangements 36 and converts the data into control signals for controlling the pressure segments of the pressure beam 34. In addition, the control device 38 controls the drive motor 18 of the workpiece transport device 10.

The transverse belt grinding assembly 24 comprises a transverse belt 40 running transversely with regard to the transport direction A, which belt is guided via rollers 42 and extends across the entire width of the transport belt 12. Both grinding assemblies 22 and 24 are known as such and can be adjusted in a known manner in the direction of the double arrow B perpendicularly with regard to the surface of the transport belt 12, which makes it possible to bring the grinding assemblies into a working position or into a resting position and to adjust them to the thickness of the workpiece.

The foregoing description shows that the workpiece 20 can be made to pass through the grinding station repeatedly by reversing the drive direction of the drive motor 18, wherein the workpiece can be machined during each passage either by both of the grinding assemblies 22, 24 or by only one of them and wherein the machining of the workpiece 20 in each case follows the contour of the workpiece.

In the shown embodiment two sensor arrangements 36 are depicted. However, it is also possible to provide only one of the sensor arrangements 36, for example the sensor arrangement 36 shown on the left in the drawing FIGURE. In this case the contour data obtained when scanning the workpiece 20 is stored in the control device 38 and inverted when the workpiece 20, after passing from the left to the right in the drawing FIGURE, moves back in the opposite direction from the right to the left such that the pressure segments of the pressure beam 34 are again controlled in the correct order corresponding to the contour of the workpiece as it enters below the grinding assembly 22.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A continuous grinding machine for grinding the surface of flat workpieces with at least one grinding station and a transport device for moving the workpieces relative to the grinding station, the grinding station having at least one grinding assembly with a grinding belt and a pressure device for pressing the grinding belt against the workpiece surface, and with a control device for controlling the pressure device depending on the workpiece contour, wherein the transport device is reversible with regard to its feed direction and in that the control device has means for detecting the workpiece contour depending on the feed direction.

2. The continuous grinding machine according to claim 1, wherein the means for detecting the workpiece contour comprise two sensor arrangements which—with respect to the first feed direction—are arranged in front of and behind the grinding assembly, respectively, and which serve to scan the contour of a workpiece moving into the grinding station.

3. The continuous grinding machine according to claim 1, wherein the means for detecting the workpiece contour comprise a sensor arrangement which—with respect to a first feed direction—is arranged in front of the grinding assembley for scanning the contour of a workpiece entering the grinding station, as well as means for inverting the contour data obtained during a first passage with respect to the direction of passage.

4. The continuous grinding machine according to claim 1, wherein the grinding station has several assemblies for machining the workpiece surface which assemblies are selectively operable.

5. The continuous grinding machine according to claim 1, wherein the grinding station has a longitudinal belt grinding assembly and/or a transverse belt grinding assembly.

6. The continuous grinding machine according to claim 1, wherein it has a plurality of grinding stations arranged subsequently in the direction of passage.

7. The continuous grinding machine according to claim 2, wherein the grinding station has several assemblies for machining the workpiece surface which assemblies are selectively operable.

8. The continuous grinding machine according to claim 3, wherein the grinding station has several assemblies for machining the workpiece surface which assemblies are selectively operable.

9. The continuous grinding machine according to claim 2, wherein the grinding station has a longitudinal belt grinding assembly and/or a transverse belt grinding assembly.

10. The continuous grinding machine according to claim 3, wherein the grinding station has a longitudinal belt grinding assembly and/or a transverse belt grinding assembly.

11. The continuous grinding machine according to claim 4, wherein the grinding station has a longitudinal belt grinding assembly and/or a transverse belt grinding assembly.

12. The continuous grinding machine according to claim 2, wherein it has a plurality of grinding stations arranged subsequently in the direction of passage.

13. The continuous grinding machine according to claim 3, wherein it has a plurality of grinding stations arranged subsequently in the direction of passage.

14. The continuous grinding machine according to claim 4, wherein it has a plurality of grinding stations arranged subsequently in the direction of passage.

15. The continuous grinding machine according to claim 5, wherein it has a plurality of grinding stations arranged subsequently in the direction of passage.

* * * * *